US007179108B2

(12) United States Patent
Goodman et al.

(10) Patent No.: US 7,179,108 B2
(45) Date of Patent: Feb. 20, 2007

(54) HERMAPHRODITIC SOCKET/ADAPTER

(75) Inventors: Glen Goodman, Cumberland, RI (US); James V. Murphy, North Kingston, RI (US)

(73) Assignee: Advanced Interconnections Corporation, West Warwick, RI (US)

( * ) Notice: Subject to any disclaimer, the term of this patent is extended or adjusted under 35 U.S.C. 154(b) by 0 days.

(21) Appl. No.: 10/935,880

(22) Filed: Sep. 8, 2004

(65) Prior Publication Data

US 2006/0051987 A1 Mar. 9, 2006

(51) Int. Cl.
*H00R 13/28* (2006.01)

(52) U.S. Cl. ..... 439/284

(58) Field of Classification Search ..... 439/74, 439/70, 284, 292, 291, 378, 924.1, 75, 331, 439/332

See application file for complete search history.

(56) References Cited

U.S. PATENT DOCUMENTS

| | | | | | |
|---|---|---|---|---|---|
| 2,124,207 | A | * | 7/1938 | Neesen | 439/284 |
| 2,384,267 | A | * | 9/1945 | Andersen | 439/293 |
| 2,437,358 | A | * | 3/1948 | Mowery | 174/88 S |
| 2,465,419 | A | * | 3/1949 | Barany | 439/284 |
| 3,432,795 | A | * | 3/1969 | Jayne | 439/60 |
| 3,582,867 | A | * | 6/1971 | Thompson et al. | 439/362 |
| 4,442,938 | A | | 4/1984 | Murphy | |
| RE32,540 | E | | 11/1987 | Murphy | |
| 5,038,467 | A | | 8/1991 | Murphy | |
| 5,088,930 | A | | 2/1992 | Murphy | |
| 5,125,848 | A | * | 6/1992 | Zimmerly | 439/291 |
| 5,227,718 | A | | 7/1993 | Stowers et al. | |
| 5,306,171 | A | * | 4/1994 | Marshall | 439/284 |
| 5,356,300 | A | * | 10/1994 | Costello et al. | 439/101 |
| 5,420,519 | A | | 5/1995 | Stowers et al. | |
| 5,545,050 | A | | 8/1996 | Sato et al. | |
| 5,576,631 | A | | 11/1996 | Stowers et al. | |
| 5,877,554 | A | | 3/1999 | Murphy | |
| 6,020,635 | A | | 2/2000 | Murphy | |
| 6,065,992 | A | * | 5/2000 | Wu et al. | 439/383 |
| 6,074,236 | A | * | 6/2000 | Wu | 439/378 |
| 6,213,787 | B1 | | 4/2001 | Murphy | |
| 6,299,492 | B1 | * | 10/2001 | Pierini et al. | 439/884 |
| 6,313,530 | B1 | | 11/2001 | Murphy | |
| 6,352,437 | B1 | | 3/2002 | Tate | |
| 6,471,524 | B1 | | 10/2002 | Nakano | |
| 6,896,523 | B2 | * | 5/2005 | Nishizawa et al. | 439/60 |

* cited by examiner

*Primary Examiner*—Phuong Dinh
(74) *Attorney, Agent, or Firm*—Fish & Richardson P.C.

(57) ABSTRACT

A hermaphroditic terminal assembly for connecting electrical devices includes an insulating support member for supporting female sockets and male pins, a number of female sockets, and a number of male pins. An intercoupling component for connecting electrical devices includes two hermaphroditic terminal assemblies configured such that the first hermaphroditic terminal assembly can be mated with the second hermaphroditic terminal assembly.

42 Claims, 4 Drawing Sheets

HERMAPHRODITIC SOCKET/ADAPTER

TECHNICAL FIELD

This invention relates to making electrical connections between electrical devices.

BACKGROUND

Electrical connection pins are a popular means for connecting two electrical devices. For example, integrated circuit (IC) packages typically possess a number of male electrical connection pins for mounting the IC package an electrical socket on a printed circuit board (PCB). Each of the male electrical connection pins of the IC package is inserted into corresponding female sockets in the electrical socket on the PCB. As technology continues to advance, the size of electrical devices continues to decrease while the number of connections required between electrical devices continues to increase. Consequently, increasing the density of electrical connection terminals for electrically connecting two electrical devices is necessary.

SUMMARY

The invention relates to a terminal assembly for electrically connecting two electrical devices. In one aspect of the invention, the terminal assembly includes an insulating support member for supporting female sockets and male pins; a number of female sockets received within a first array of apertures in the insulating support member, each aperture extending from the upper surface of the insulating support member to the bottom surface of the insulating support member; and a number of male pins received within a second array of apertures in the insulating support member, each aperture extending from the upper surface of the insulating support member to the bottom surface of the insulating support member.

Preferred embodiments of this aspect of the invention may include one or more of the following features. The female sockets and male pins are arranged in a pattern such that each interstitial space between the sockets is occupied by a pin and each interstitial space between the pins is occupied by a socket. The terminal assembly is used to electrically connect a first circuit board to a second circuit board. The terminal assembly is used to electrically connect an IC package to a circuit board. The height of at least one of the male pins is different than the height of every other pin. The terminal assembly includes at least one alignment element to align the female sockets and male pins with corresponding male pins and female sockets on a second terminal assembly. For example, the terminal assembly includes at least one alignment guide post or at least one alignment guide hole. The alignment guide post is capable of serving as an electric power, voltage, or ground connection. In these embodiments, the alignment guide posts are advantageously dual-purposed: serving to both align electrical connections between electrical devices as well as to provide an electrical path themselves. The terminal assembly further includes a member that applies a downward force on the terminal assembly and to each pin and socket.

In another aspect of this invention, an intercoupling component for electrically connecting two electrical devices includes two terminal assemblies of the type described above. The two terminal assemblies are used to electrically connect two electrical devices by inserting the male pins of the first terminal assembly into the female sockets of the second terminal assembly and by inserting the male pins of the second terminal assembly into the female sockets of the first terminal assembly.

Among other advantages, intercoupling components having the structure discussed above provides all of the advantages associated with traditional socket/adapter technology (e.g., non-permanent connections) while providing a substantial increase in the density of electrical connections between electrical devices or substrates (e.g., printed circuit boards) having electrical connections.

Preferred embodiments of this aspect of the invention may include one or more of the following features. The female sockets and male pins of the first terminal assembly are arranged in a pattern such that each interstitial space between the sockets is occupied by a pin and each interstitial space between the pins is occupied by a socket. The female sockets and male pins of the second terminal assembly are arranged in a pattern corresponding to the pattern of the female sockets and male pins of the first terminal assembly such that each interstitial space between the sockets is occupied by a pin and each interstitial space between the pins is occupied by a socket. The intercoupling component is used to electrically connect a first circuit board to a second circuit board. The intercoupling component is used to electrically connect an IC package to a circuit board.

In certain embodiments, the first terminal assembly is identical to the second terminal assembly. The height of at least one of the male pins of the first terminal assembly is different than the height of every other pin of the first terminal assembly. The height of at least one of the male pins of the second terminal assembly is different than the height of every other pin of the second terminal assembly. Both the first terminal assembly and the second terminal assembly include at least one alignment element each to align the female sockets and male pins of the first terminal assembly with corresponding male pins and female sockets of the second terminal assembly. For example, the first terminal assembly includes at least one alignment guide post that is inserted into at least one alignment guide hole in the second terminal assembly. The alignment guide post is capable of serving as an electric power, voltage, or ground connection. The intercoupling component further includes a member that applies a downward force on the intercoupling component.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
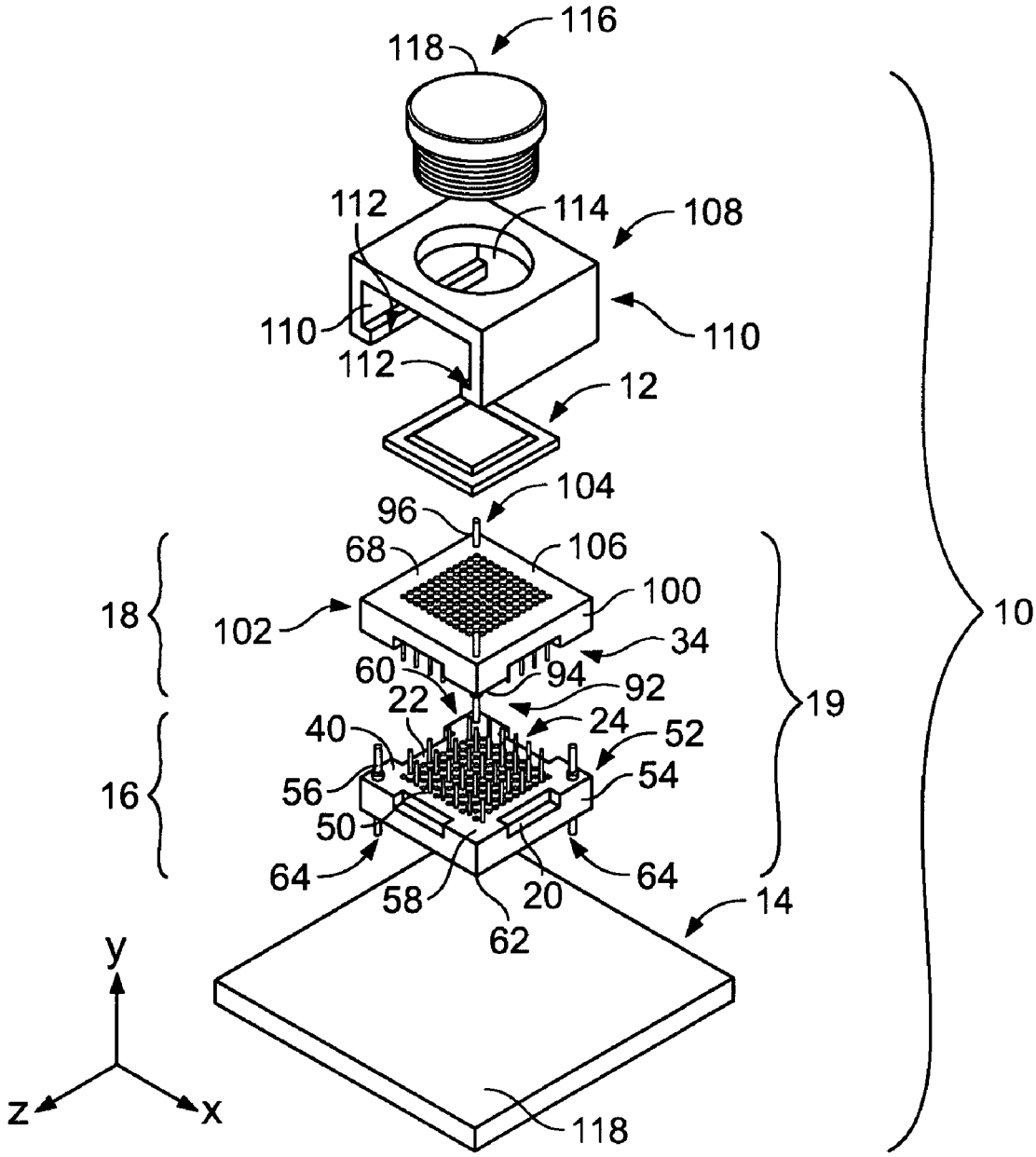
FIG. 1 is an exploded, isometric view of an intercoupling component including two hermaphroditic terminal assemblies, an IC package, and a hold-down assembly positioned over a printed circuit board.
Figure 2A:
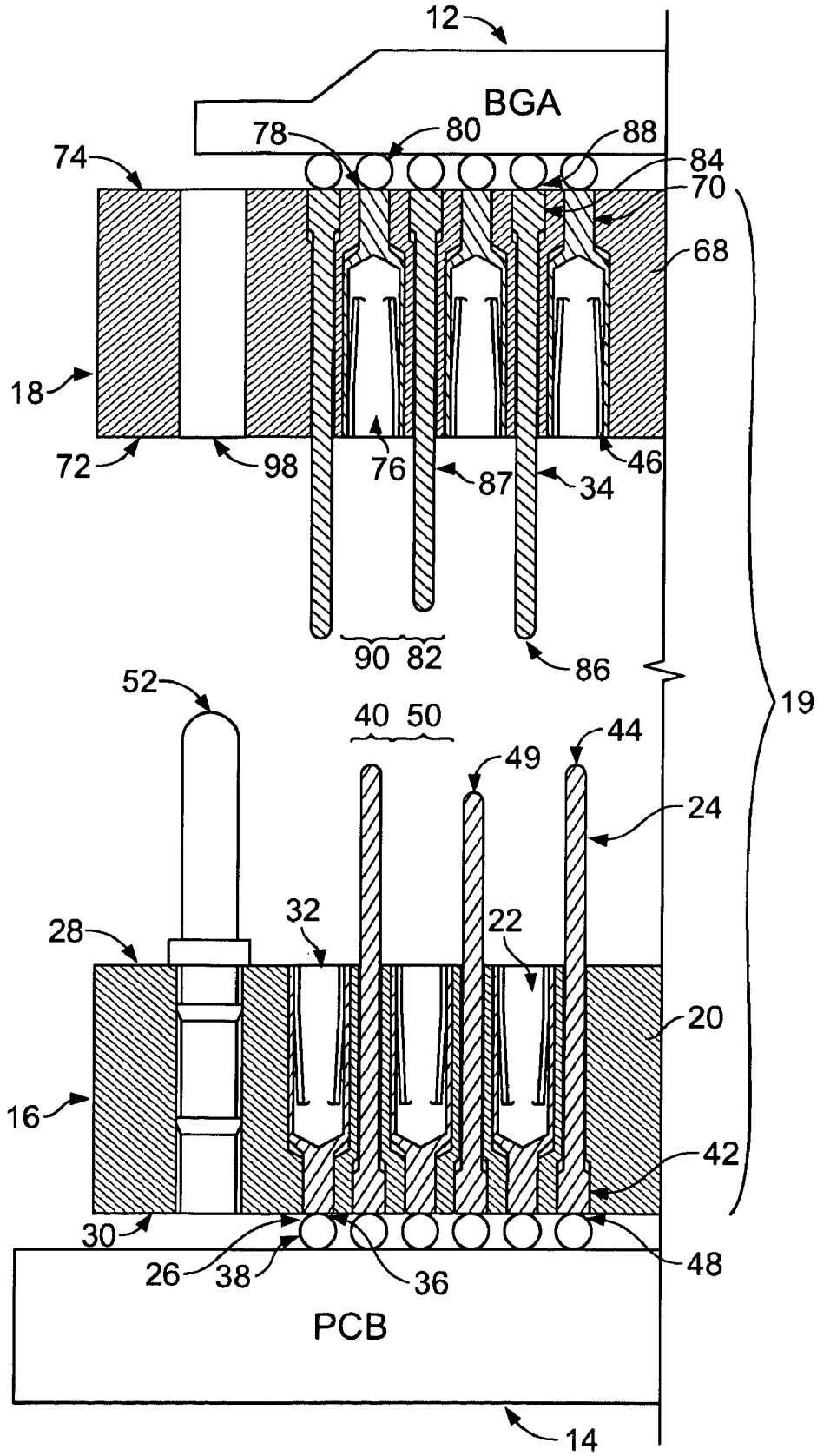
FIGS. 2A–2B are cross-sectional side views of a portion of the intercoupling component of FIG. 1.
Figure 2B:
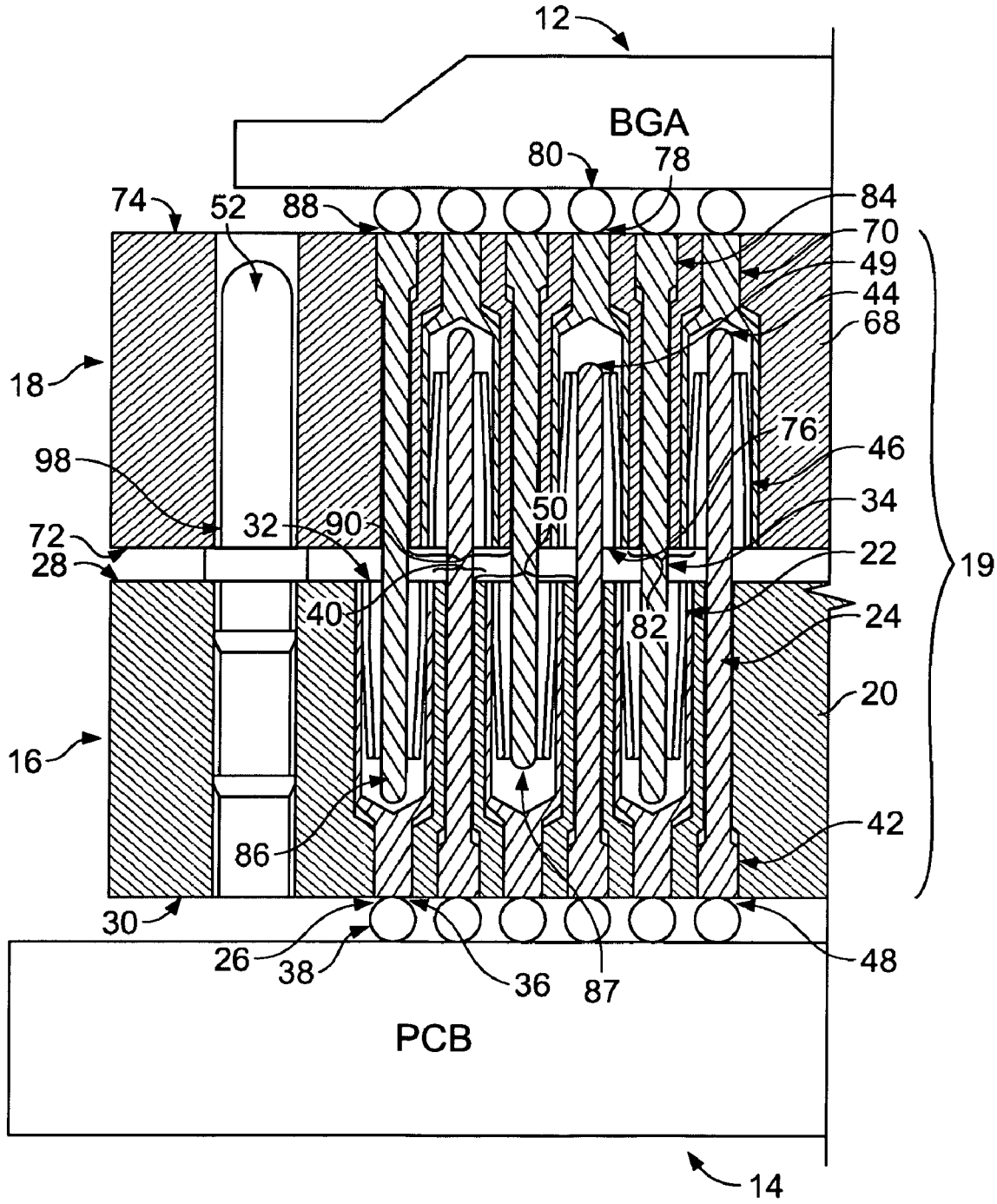

Referring to FIGS. 1, 2A, and 2B, a hermaphroditic socket/adapter assembly 10 for electrically connecting an IC package 12 to a PCB 14 is shown. Hermaphroditic socket/ adapter assembly 10, includes a first hermaphroditic terminal assembly 16 and a second hermaphroditic terminal assembly 18 that together comprise an intercoupling component 19.

First hermaphroditic terminal assembly 16 includes an insulating support member 20 for supporting female sockets 22 and male pins 24. Insulating support member 20 includes a first array of apertures 26, extending from the upper surface 28 of insulating support member 20 to the bottom surface 30 of insulating support member 20. Each female socket 22 is received within one aperture 26 of the first array of apertures of the insulating support member 20. Each female socket 22 has a first end 32 configured to receive a corresponding male pin 34 of the second hermaphroditic terminal assembly 18 and a second end 36 attached to a solder ball 38 that establishes an electrical connection with the electrical contact 39 on PCB 14. The female sockets 22 received within the first array of apertures 26 of the insulating support member 20 are arranged such that interstitial spaces 40 exist between the female sockets 22.

Insulating support member 20 also includes a second array of apertures 42, extending from the upper surface 28 of insulating support member 20 to the bottom surface 30 of insulating support member 20. Each male pin 24 is received within one aperture 42 of the second array of apertures of the insulating support member 20. Each male pin has a first end 44 configured to be received within a corresponding female socket 46 of the second hermaphroditic terminal assembly 18 and a second end 48 attached to a solder ball 38 that establishes an electrical connection with electrical contact 39 on PCB 14. In some applications, it may be desirable for at least one male pin 49 to be of a different height than every other male pin 24 where the height of a pin is defined as the length from the first end of the pin 44 to the second end of the pin 48. Varying the height of the pins serves to decrease the force required to insert the first hermaphroditic terminal assembly 16 into a corresponding hermaphroditic terminal assembly. Varying the height of the pins also serves to decrease the force required to extract the first hermaphroditic terminal assembly 16 from a corresponding hermaphroditic terminal assembly into which it has been inserted. The male pins 24 received within the second array of apertures 42 of the insulating support member 20 are arranged such that interstitial spaces 50 exist between the male pins 24. Collectively, the female sockets 22 and the male pins 24 are arranged in a pattern such that the interstitial spaces 40 between the female sockets 22 are occupied by male pins 24, and the interstitial spaces 50 between the male pins 24 are occupied by female sockets 22. It is appreciated that the female sockets 22 and the male pins 24 could be arranged in different patterns.

First hermaphroditic terminal assembly 16 also includes two alignment guide posts 52 located in opposite corners 54, 56 of first hermaphroditic terminal assembly 16 and disposed through the upper surface 28 of the insulating support member 20 and two alignment guide holes 58 located in opposite corners 60, 62 of the upper surface 28 of the insulating support member 20. In addition, first hermaphroditic terminal assembly 16 includes two alignment guide posts 64 located in opposite corners 54, 56 of first hermaphroditic terminal assembly 16 and disposed through the lower surface 30 of the insulating support member 20 and two alignment guide holes (not shown) located in opposite corners 60, 62 of the lower surface 30 of the insulating support member 20.

Second hermaphroditic terminal assembly 18 includes an insulating support member 68 for supporting female sockets 46 and male pins 34. Insulating support member 68 includes a first array of apertures 70, extending from the upper surface 72 of insulating support member 68 to the bottom surface 74 of insulating support member 68. Each female socket 46 is received within one aperture 70 of the first array of apertures of the insulating support member 68. Each female socket 46 has a first end 76 configured to receive a corresponding male pin 24 of the first hermaphroditic terminal assembly 16 and a second end 78 configured to contact a solder ball 80 on IC package 12. The female sockets 46 received within the first array of apertures 70 of the insulating support member 68 are arranged such that interstitial spaces 82 exist between the female sockets 46.

Insulating support member 68 also includes a second array of apertures 84, extending from the upper surface 72 of insulating support member 68 to the bottom surface 74 of insulating support member 68. Each male pin 34 is received within one aperture 84 of the second array of apertures of the insulating support member 68. Each male pin has a first end 86 configured to be received within a corresponding female socket 22 of the first hermaphroditic terminal assembly 16 and a second end 88 configured to contact a corresponding solder ball 80 on IC package 12. In some applications, it may be desirable for at least one male pin 87 to be of a different height than every other male pin 34, where the height of a pin is defined as the length from the first end of the pin 86 to the second end of the pin 88. Varying the height of the pins serves to decrease the force required to insert the second hermaphroditic terminal assembly 18 into a corresponding hermaphroditic terminal assembly. Varying the height of the pins also serves to decrease the force required to extract the second hermaphroditic terminal assembly 18 from a corresponding hermaphroditic terminal assembly into which it has been inserted. The male pins 34 received within the second array of apertures 84 of the insulating support member 68 are arranged such that interstitial spaces 90 exist between the male pins 34. Collectively, the female sockets 46 and the male pins 34 are arranged in a pattern such that the interstitial spaces 82 between the female sockets 46 are occupied by male pins 34, and the interstitial spaces 90 between the male pins 34 are occupied by female sockets 46. It is appreciated that the female sockets 46 and the male pins 34 could be arranged in different patterns.

Second hermaphroditic terminal assembly 18 also includes two alignment guide posts 92 located in opposite corners 94, 96 of second hermaphroditic terminal assembly 18 and disposed through the upper surface 72 of the insulating support member 68 and two alignment guide holes 98 located in opposite corners 100, 102 of the upper surface 72 of the insulating support member 68. In addition, second hermaphroditic terminal assembly 18 includes two alignment guide posts 104 located in opposite corners 94, 96 of second hermaphroditic terminal assembly 18 and disposed through the lower surface 74 of the insulating support member 68 and two alignment guide holes 98 located in opposite corners 100, 102 of the lower surface 74 of the insulating support member 68.

The intercoupling component 19 is used to electrically connect IC package 12 to PCB 14. IC package 12 is secured to the lower surface 74 of insulating support member 68 of the second hermaphroditic terminal assembly 18 such that the solder balls 80 on IC package 12 are brought into contact with the second ends 78 of the female sockets 46 of the second hermaphroditic terminal assembly 18 and the second ends 88 of the male pins 34 of the second hermaphroditic terminal assembly 18. The alignment guide posts 104 disposed through the lower surface 74 the insulating support member 68 of the second terminal assembly can be used to properly align the solder balls 80 on IC package 12 with the second ends 78 of the female sockets 46 of the second hermaphroditic terminal assembly 18 and the second ends 88 of the male pins 34 of the second hermaphroditic terminal assembly 18. It is appreciated that other alignment elements could be used to facilitate proper alignment of the solder balls 80 on IC package 12 with the second ends 78 of the female sockets 46 of the second hermaphroditic terminal assembly 18 and the second ends of the male pins 34 of the second hermaphroditic terminal assembly 18. It is also appreciated that alignment elements are not required to properly align the electrical contacts 80 on IC package 12 with the second ends 78 of the female sockets 46 of the second hermaphroditic terminal assembly 18 and the second ends of the male pins 34 of the second hermaphroditic terminal assembly 18.

Hermaphroditic socket/adapter assembly 10 includes a hold-down cover 108 for securing the IC package 12 to the intercoupling component 19. Hold-down cover 108 includes a pair of opposite walls 110 having tab members 112 that engage the intercoupling component 19. Hold-down cover 108 includes a threaded thru-hole 114 that threadingly receives a heat sink 116 to provide a thermal path for dissipating heat from the IC package 12. Heat sink 116 is inserted through threaded thru-hole 114 and a slot 118 formed in the heat sink 116 facilitates threading the heat sink 116 within the cover, for example, with a screwdriver or coin. It is appreciated that other mechanisms may also be used to secure the IC package 12 to the intercoupling component 19. It is also appreciated that other heat sink arrangements may be substituted for the version shown in FIG. 1. In some applications, a heat sink may not be required. Therefore, it is appreciated that the hold-down cover 108 may be used to secure the IC package 12 to the intercoupling component 19 without a heat sink. It is also appreciated that the hold-down cover itself may not be necessary to secure the IC package 12 to the intercoupling component 19. In some applications, the IC package 12 may be soldered directly to the intercoupling component 19.

The second hermaphroditic terminal assembly 18 is coupled to the first hermaphroditic terminal assembly 16 by inserting each male pin 34 of the second terminal assembly 18 into a corresponding female socket 22 of the first hermaphroditic terminal assembly 16 and inserting each male pin 24 of the first hermaphroditic terminal assembly 16 into a corresponding female socket 46 of the second hermaphroditic terminal assembly 18. When the second hermaphroditic terminal assembly 18 is coupled to the first hermaphroditic terminal assembly 16, it is said to be mated with the first hermaphroditic terminal assembly 16. The alignment guide posts 92 disposed through the upper surface 72 of the insulating support member 68 of the second hermaphroditic terminal assembly 18 are inserted into alignment guide holes 58 in the upper surface 28 of the insulating support member 20 of the first hermaphroditic terminal assembly 16 and the alignment guide posts 52 disposed through the upper surface 28 of the first hermaphroditic terminal assembly 16 are inserted into alignment guide holes 98 in the upper surface 72 of the insulating support member 68 of the second hermaphroditic terminal assembly 18 to properly align the male pins 34 of the second hermaphroditic terminal assembly 18 with the corresponding female sockets 22 of the first hermaphroditic terminal assembly 16 and the male pins 24 of the first hermaphroditic terminal assembly 16 with the corresponding female sockets 46 of the second hermaphroditic terminal assembly 18. It is appreciated that other alignment elements could be used to facilitate proper alignment of the male pins 34 of the second hermaphroditic terminal assembly 18 with the corresponding female sockets 22 of the first hermaphroditic terminal assembly 16 and the male pins 24 of the first hermaphroditic terminal assembly 16 with the corresponding female sockets 46 of the second hermaphroditic terminal assembly 18. It is also appreciated that alignment elements are not required to properly align the male pins 34 of the second hermaphroditic terminal assembly 18 with the corresponding female sockets 22 of the first hermaphroditic terminal assembly 16 and the male pins 24 of the first hermaphroditic terminal assembly 16 with the corresponding female sockets 46 of the second hermaphroditic terminal assembly 18. In some applications, it may be advantageous for the alignment guide posts 92 disposed through the upper surface 72 of insulating support member 68 of the second hermaphroditic terminal assembly 18 and the alignment guide posts 52 disposed through the upper surface 28 of the first hermaphroditic terminal assembly 16 to serve as power, voltage, or ground connections.

Referring to FIG. 1, first hermaphroditic terminal assembly 16 is identical to second hermaphroditic terminal assembly 18. In order to connect first hermaphroditic terminal assembly 16 to second hermaphroditic terminal assembly 18, second hermaphroditic terminal assembly 18 is rotated 90 degrees so that the male pins 34 of the second hermaphroditic terminal assembly 18 are aligned with corresponding female sockets 22 of the first hermaphroditic terminal assembly 16 and the male pins 24 of the first hermaphroditic terminal assembly 16 are aligned with corresponding female sockets 46 of the second hermaphroditic terminal assembly 18. It is appreciated that the first hermaphroditic terminal assembly 16 need not be identical to the second hermaphroditic terminal assembly 18.

First hermaphroditic terminal assembly 16 is secured to PCB 14 such that the solder balls 38 attached to second ends 36 of the female sockets 22 of the first hermaphroditic terminal assembly 16 and the solder balls 38 attached to second ends 48 of the male pins 24 of the first hermaphroditic terminal assembly 16 are in contact with the electrical contacts 39 on PCB 14. The alignment guide posts 64 disposed through the lower surface 30 of the insulating support member 20 of the first hermaphroditic terminal assembly 16 are inserted into alignment guide holes 128 in PCB 14. It is appreciated that other alignment elements could be used to facilitate proper alignment of the solder balls 38 attached to second ends 36 of the female sockets 22 of the first hermaphroditic terminal assembly 16 and the solder balls 38 attached to second ends 48 of the male pins 24 of the first hermaphroditic terminal assembly 16 with the electrical contacts 39 on PCB 14. It is also appreciated that alignment elements are not required.

When IC package 12 is secured to the lower surface 74 of insulating support member 68 of the second hermaphroditic terminal assembly 18 such that the solder balls 80 on IC package 12 are in contact with the second ends 78 of the female sockets 46 of the second hermaphroditic terminal assembly 18 and the second ends 88 of the male pins 34 of the second hermaphroditic terminal assembly 18; second hermaphroditic terminal assembly 18 is coupled to the first hermaphroditic terminal assembly 16 such that each male pin 34 of the second hermaphroditic terminal assembly 18 is received within a corresponding female socket 22 of the first hermaphroditic terminal assembly 16 and each male pin 24 of the first hermaphroditic terminal assembly 16 is received within a corresponding female socket 46 of the second hermaphroditic terminal assembly 18; and first hermaphroditic terminal assembly 16 is secured to PCB 14 such that that the solder balls 38 attached to second ends 36 of the female sockets 22 of the first hermaphroditic terminal assembly 16 and the solder balls 38 attached to second ends 48 of the male pins 24 of the first terminal assembly 16 are in contact with the electrical contacts 39 on PCB 14, the IC package 12 being electrically connected to PCB 14.

FIGS. 2A and 2B illustrate the operation of intercoupling component 19. The solder balls 38 attached to second ends 36 of the female sockets 22 of the first hermaphroditic terminal assembly 16 and the solder balls 38 attached to second ends 48 of the male pins 24 of the first hermaphroditic terminal assembly 16 are in contact with the electrical contacts 39 on PCB 14. Similarly, the second ends 78 of the female sockets 46 of the second hermaphroditic terminal assembly 18 and the second ends 88 of the male pins 34 of the second hermaphroditic terminal assembly 18 are in contact with the solder balls 80 on IC package 12. Referring to FIG. 2A, IC package 12 and PCB 14 are not electrically connected. Referring to FIG. 2B, intercoupling component 19 is used to electrically connect IC package 12 and PCB 14. The electrical connection between IC package 12 and PCB 14 is formed by inserting each male pin 34 of the second hermaphroditic terminal assembly 18 into a corresponding female socket 22 of the first hermaphroditic terminal assembly 16 and inserting each male pin 24 of the first hermaphroditic terminal assembly 16 into a corresponding female socket 46 of the second hermaphroditic terminal assembly 18.

Figure 3:
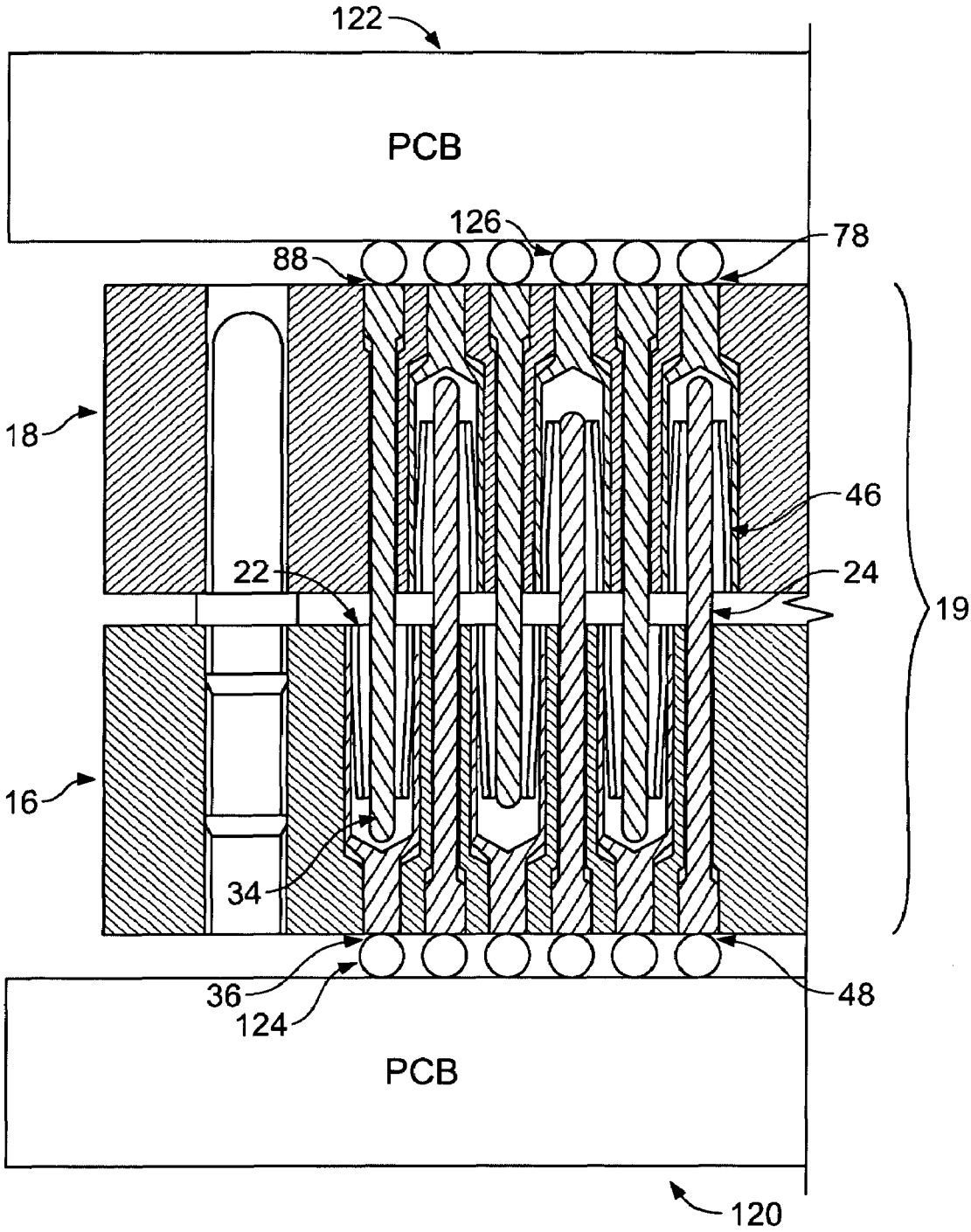
FIG. 3 is a cross-sectional side view of a portion of an alternative embodiment of an intercoupling component.

A number of embodiments of the invention have been described. Nevertheless, it will be understood that various modifications may be made without departing from the spirit and scope of the invention. For example, hermaphroditic terminal assemblies can be used to electrically connect many different types of electrical devices. Referring to FIG. 3, intercoupling component 19, including first hermaphroditic terminal assembly 16 and second hermaphroditic terminal assembly 18, are used to electrically connect a first PCB 120 to a second PCB 122. The second ends 36 of the female sockets 22 of the first hermaphroditic terminal assembly 16 and the second ends 48 of the male pins 24 of the first hermaphroditic terminal assembly 16 are connected to solder balls 124 and form an electrical connection with the electrical contacts 125 on first PCB 120. Similarly, the second ends 78 of the female sockets 46 of the second hermaphroditic terminal assembly 18 and the second ends 88 of the male pins 34 of the second hermaphroditic terminal assembly 18 are connected to solder balls 126 and form an electrical connection with the electrical contacts 127 on second PCB 122. The electrical connection between first PCB 120 and second PCB 122 is formed by inserting each male pin 34 of the second hermaphroditic terminal assembly 18 into a corresponding female socket 22 of the first hermaphroditic terminal assembly 16 and inserting each male pin 24 of the first hermaphroditic terminal assembly 16 into a corresponding female socket 46 of the second hermaphroditic terminal assembly 18. Accordingly, other embodiments are within the scope of the following claims.

What is claimed is:

1. A terminal assembly of the type used to electrically connect electrical devices, the terminal assembly comprising:

an insulating support member including a first array of apertures, each aperture extending from an upper surface to an opposite lower surface of the insulating support member and configured to receive a socket, and a second array of apertures, each aperture extending from the upper surface to the opposite lower surface of the insulating support member and configured to receive a pin;

a plurality of sockets for providing electrical connections arranged in a configuration corresponding with the first array of apertures, each socket received within a corresponding aperture of the first array of apertures of the insulating support member and having an end with an opening configured to receive a pin of a corresponding terminal assembly and an opposite end configured to contact a corresponding electrical contact; and a plurality of pins for providing electrical connections arranged in a configuration corresponding with the second array of apertures, each pin received within an opening of a corresponding aperture of the second array of apertures of the insulating support member and having an end configured to be received within a socket of a corresponding terminal assembly and an opposite end configured to contact a corresponding electrical contact, the pins defining a plurality of voids between adjacent pins, each void extending from a surface of one pin to a surface of an adjacent pin;

wherein the terminal assembly further comprises a plurality of interstitial spaces between the sockets; and a plurality of interstitial spaces between the pins; and wherein the plurality of sockets and the plurality of pins are arranged in a pattern comprising a plurality of rows and columns, each column arranged in an alternating sequences of sockets and pins that each interstitial space between the sockets is occupied by a pin and each interstitial space between the pins is occupied by a socket, each row arranged in an alternating sequence of sockets and pins that each interstitial space between the sockets is occupied by a pin and each interstitial space between the pins is occupied by a socket.

2. The terminal assembly of claim 1 wherein the terminal assembly is of the type used to electrically connect a first circuit board to a second circuit board.

3. The terminal assembly of claim 1 wherein the terminal assembly is of the type used to electrically connect the electrical contacting area of an integrated circuit package to an electrical contacting area of a circuit board.

4. The terminal assembly of claim 1 wherein the height of at least one pin of the plurality of pins is different than the height of every other pin.

5. The terminal assembly of claim 1 wherein the insulating support member includes at least one alignment element to align the plurality of sockets with a corresponding plurality of pins on a corresponding terminal assembly, and to align the plurality of pins with a corresponding plurality of sockets on a corresponding terminal assembly.

6. The terminal assembly of claim 5 wherein the at least one alignment element comprises at least one alignment guide post disposed through the insulating support member to be received by a corresponding alignment hole in a corresponding terminal assembly.

7. The terminal assembly of claim 6 wherein the at least one guide post provides an electrical connection.

8. The terminal assembly of claim 6 wherein the height of the at least one guide post is greater than the height of the plurality of pins.

9. The terminal assembly of claim 1 further comprising a member configured to apply a downward force on the terminal assembly and to pin and each socket.

10. The terminal assembly of claim 1 further comprising a plurality of interstitial spaces between the sockets;

and wherein each interstitial space between the sockets is occupied by a pin.

11. The terminal assembly of claim 1 further comprising a plurality of interstitial space between the pins;

and wherein each interstitial space between the pins is occupied by a socket.

12. The terminal assembly of claim 10 further comprising a plurality of interstitial spaces between the pins;

and wherein each interstitial space between the pins is occupied by a socket.

13. The terminal assembly of claim 1 wherein the plurality of sockets and the plurality of pins are arranged in a pattern comprising a plurality of columns of sockets and at least one column of pins such that the columns of sockets and the at least one column of pins form an alternating sequence of columns of sockets and columns of pins.

14. The terminal assembly of claim 1 wherein the plurality of sockets and the plurality of pins are arranged in a pattern comprising a plurality of columns of pins and at least one column of sockets such that the columns of pins and the at least one column of sockets form an alternating sequence of columns of pins and columns of sockets.

15. An intercoupling component of the type used to electrically connect electrical devices, the intercoupling component comprising:

a first terminal assembly including:

a first insulating support member having a first array of apertures, each aperture extending from an upper surface to an opposite lower surface of the first insulating support member and configured to receive a socket, and a second array of apertures, each aperture extending from an upper surface to an opposite lower surface of the first insulating support member and configured to receive a pin;

a first plurality of sockets for providing electrical connections arranged in a configuration corresponding with the first array of apertures, each socket received within a corresponding aperture of the first array of apertures of the first insulating support member and having an end with an opening configured to receive a pin of a corresponding terminal assembly and an opposite end configured to contact a corresponding electrical contact;

a first plurality of pins for providing electrical connections arranged in a configuration corresponding with the second array of apertures, each pin received within an opening of a corresponding aperture of the second array of apertures of the first insulating support member and configured to be received within a socket of a corresponding terminal assembly and an opposite end configured to contact a corresponding electrical contact, the first plurality of pins defining a first plurality of voids between adjacent pins, each void of the first plurality of voids extending from a surface of one pin to a surface of an adjacent pin;

wherein the first terminal assembly further comprise a plurality of interstitial spaces between the first plurality of sockets, and a plurality of Interstitial spaces between the first plurality of pins;

and wherein the first plurality of sockets and the first plurality of pins of the first terminal assembly are arranged in a pattern comprising:

a plurality of columns, each column arranged in an alternating sequence of sockets and pins such that each interstitial space between the sockets is occupied by a pin and each interstitial space between the pins is occupied by a socket; and a plurality of rows, each row arranged in an alternating sequence of sockets and pins such that each interstitial space between the sockets is occupied by a pin and each interstitial space between the pins is occupied by a socket;

a second terminal assembly including:

a second insulating support member having a third array of apertures, each aperture extending from an upper surface to an opposite lower surface of the second insulating support member and configured to receive a socket, and a fourth array of apertures, each aperture extending from an upper surface to an opposite lower surface of the second insulating support member and configured to receive a pin;

a second plurality of sockets for providing electrical connections arranged in a configuration corresponding with the third array of apertures, each socket received within a corresponding aperture of the third array of apertures of the second insulating support member and having an end with an opening configured to receive a corresponding pin of the first terminal assembly and an opposite end configured to contact a corresponding electrical contact;

a second plurality of pins for providing electrical connections arranged in a configuration corresponding with the fourth array of apertures, each pin received within an opening of a corresponding aperture of the fourth array of apertures of the second insulating support member and having an end configured to be received within a corresponding socket of the first terminal assembly and an opposite end configured to contact a corresponding electrical contact, the pins defining a second plurality of voids between adjacent pins, each void of the second plurality of voids extending from a surface of one pin to a surface of an adjacent pin.

16. The intercoupling component of claim 15 wherein the second terminal assembly further comprises a plurality of interstitial spaces between the second plurality of sockets and a plurality of interstitial spaces between the second plurality of pins;

and wherein the second plurality of sockets and the second plurality of pins of the second terminal assembly are arranged in a pattern comprising:

a plurality of columns, each column arranged in an alternating sequence of sockets and pins such that each interstitial space between the sockets is occupied by a pin and each interstitial space between the pins is occupied by a socket; and a plurality of rows, each row arranged in an alternating sequence of sockets and pins such that each interstitial space between the sockets is occupied by a pin and each interstitial space between the pins is occupied by a socket;

such that each pin of the first terminal assembly can mate with a corresponding socket of the second terminal assembly, and each pin of the second terminal assembly can mate with a corresponding socket of the first terminal assembly.

17. The intercoupling component of claim 16 wherein the first terminal assembly is coupled to a first circuit board, and the second terminal assembly is coupled to a second circuit board such that the intercoupling component can be used to electrically connect the first circuit board to the second circuit board.

18. The intercoupling component of claim 16 wherein the first terminal assembly is coupled to the electrical contacting area of an integrated circuit package, and the second terminal assembly is coupled to an electrical contacting area of a circuit board such that the intercoupling component can be used to electrically connect the integrated circuit package to the circuit board.

19. The intercoupling component of claim 16 wherein the first terminal assembly is identical to the second terminal assembly.

20. The intercoupling component of claim 16 wherein the height of at least one pin of the first plurality of pins of the first terminal assembly is different than the height of every other pin of the first plurality of pins of the first terminal assembly; and the height of at least one pin of the second plurality of pins of the second terminal assembly is different than the height of every other pin of the second plurality of pins of the second terminal assembly.

21. The intercoupling component of claim 16 wherein the second insulating support member of the second terminal assembly includes at least one alignment element to align the first plurality of sockets of the first terminal assembly with the second plurality of pins of the second terminal assembly, and to align the first plurality of pins of the first terminal assembly with the second plurality of sockets of the second terminal assembly.

22. The intercoupling component of claim 21 wherein the at least one alignment element comprises at least one alignment guide post disposed through the second insulating support member to be received by a corresponding alignment hole in the first terminal assembly.

23. The intercoupling component of claim 22 wherein the at least one guide post provides an electrical connection.

24. The intercoupling component of claim 16 wherein the first insulating support member of the first terminal assembly includes at least one alignment element to align the first plurality of sockets of the first terminal assembly with the second plurality of pins of the second terminal assembly, and to align the first plurality of pins of the first terminal assembly with the second plurality of sockets of the second terminal assembly.

25. The intercoupling component of claim 24 wherein the at least one alignment element comprises at least one alignment guide post disposed through the first insulating support member to be received by a corresponding alignment hole in the second terminal assembly.

26. The intercoupling component of claim 25 wherein the at least one guide post provides an electrical connection.

27. The intercoupling component of claim 16 further comprising a member configured to apply a force on the intercoupling component.

28. A method of manufacturing a terminal assembly of the type used to electrically connect electrical devices, the method comprising:

providing an insulating support member including a first array of apertures, each aperture extending from an upper surface to an opposite lower surface of the insulating support member and configured to receive a socket, and a second array of apertures, each aperture extending from the upper surface to the opposite lower surface of the insulating support member and configured to receive a pin;

providing a plurality of sockets for providing electrical connections, each socket having an end with an opening configured to receive a pin of a corresponding terminal assembly and an opposite end configured to contact a corresponding electrical contact, arranged in a configuration corresponding with the first array of apertures such that each socket is received within a corresponding aperture of the first array of apertures of the insulating support member; and providing a plurality of pins for providing electrical connections, each pin having an end configured to be received within a socket of a corresponding terminal assembly and an opposite end configured to contact a corresponding electrical contact, arranged in a configuration corresponding with the second array of apertures such that each pin is received within an opening of a corresponding aperture of the second array of apertures of the insulating support member, the pins defining a plurality of voids between adjacent pins, each void extending from a surface of one pin to a surface of an adjacent pin, the configuration of the plurality of sockets defines a plurality of interstitial spaces between the sockets;

the configuration of the plurality of pins defines a plurality of interstitial spaces between the pins; and the plurality of sockets and the plurality of pins are arranged in a pattern comprising a plurality of columns and rows, each column arranged in an alternative sequence of sockets and pins such that each interstitial space between the sockets is occupied by a pin and each interstitial space between the pins is occupied by a socket, each row arranged in an alternating sequence of sockets and pins such that each interstitial space between the sockets is occupied by a pin and each interstitial space between the pins is occupied by a socket.

29. The method of manufacturing a terminal assembly of claim 28, wherein the height of at least one pin of the plurality of pins is different than the height of every other pin.

30. The method of manufacturing a terminal assembly of claim 28, wherein the configuration of the plurality of sockets defines a plurality of interstitial spaces between the sockets; and each interstitial space between the sockets is occupied by a pin.

31. The method of manufacturing a terminal assembly of claim 28, wherein the configuration of the plurality of pins defines a plurality of interstitial spaces between the pins; and each interstitial space between the pins is occupied by a socket.

32. The method of manufacturing a terminal assembly of claim 28, wherein the configuration of the plurality of sockets defines a plurality of interstitial spaces between the sockets;

the configuration of the plurality of pins defines a plurality of interstitial spaces between the pins; and each interstitial space between the sockets is occupied by a pin, and each interstitial space between the pins is occupied by a socket.

33. The method of manufacturing a terminal assembly of claim 28, wherein the plurality of sockets and the plurality of pins are arranged in a pattern comprising a plurality of columns of sockets and at least one column of pins such that the columns of sockets and the at least one column of pins form an alternating sequence of columns of sockets and columns of pins.

34. The method of manufacturing a terminal assembly of claim 28, wherein the plurality of sockets and the plurality of pins are arranged in a pattern comprising a plurality of columns of pins and at least one column of sockets such that the columns of pins and the at least one column of sockets form an alternating sequence of columns of pins and columns of sockets.

35. A method of manufacturing an intercoupling component of the type used to electrically connect electrical devices, the method comprising:

providing a first terminal assembly including:

a first insulating support member having a first array of apertures, each aperture extending from an upper surface to an opposite lower surface of the first insulating support member and configured to receive a socket, and a second array of apertures, each aperture extending from an upper surface to an opposite lower surface of the first insulating support member and configured to receive a pin;

a first plurality of sockets for providing electrical connections arranged in a configuration corresponding with the first array of apertures, each socket received within a corresponding aperture of the first array of apertures of th,e first insulating support member and having an end with an opening configured to receive a pin of a corresponding terminal assembly and an opposite end configured to contact a corresponding electrical contact; and a first plurality of pins for providing electrical connections arranged in a configuration corresponding with the second array of apertures, each pin received within an opening of a corresponding aperture of the second array of apertures of the first insulating support member and configured to be received within a socket of a corresponding terminal assembly and an opposite end configured to contact a corresponding electrical contact, the first plurality of pins defining a first plurality of voids between adjacent pins, each void of the first plurality of voids extending from a surface of one pin to a surface of an adjacent pin;

wherein the first terminal assembly comprises a plurality of interstitial spaces between the first plurality of sockets, and a plurality of interstitial spaces between the first plurality of pins;

and wherein the first plurality of sockets and the first plurality of pins of the first terminal assembly are arranged in a pattern comprising:

a plurality of columns, each column arrangedin an alternating sequence of sockets and pins such that each interstitial space between the sockedt is occupied by a pin and each interstitial space between the pins is occupied by a socket; and a plurality of rows, each row arranged in an alternating sequence of sockets and pins such that each interstitial space between the sockets is occupied by a pin and each interstitial space between the pins is occupied by a socket; and providing a second terminal assembly including:

a second insulating support member having a third array of apertures, each aperture extending from an upper surface to an opposite lower surface of the second insulating support member and configured to receive a socket, and a fourth array of apertures, each aperture extending from an upper surface to an opposite lower surface of the second insulating support member and configured to receive a pin;

a second plurality of sockets for providing electrical connections arranged in a configuration corresponding with the third array of apertures, each socket received within a corresponding aperture of the third array of apertures of the second insulating support member and having an end with an opening configured to receive a corresponding pin of the first terminal assembly and an opposite end configured to contact a corresponding electrical contact; and a second plurality of pins for providing electrical connections arranged in a configuration corresponding with the fourth array of apertures, each pin received within an opening of a corresponding aperture of the fourth array of apertures of the second insulating support member and having an end configured to be received within a corresponding socket of the first terminal assembly and an opposite end configured to contact a corresponding electrical contact, the second plurality of pins defining a second plurality of voids between adjacent pins, each void of the second plurality of voids extending from a surface of one pin to a surface of an adjacent pin.

36. The method of manufacturing an intercoupling component of claim 35, wherein the second terminal assembly further comprises a plurality of interstitial spaces between the second plurality of sockets, and a plurality of interstitial spaces between the second plurality of pins;

and wherein the second plurality of sockets and the second plurality of pins of the second terminal assembly are arranged in a pattern comprising a plurality of columns, each column arranged in an alternating sequence of sockets and pins such that each interstitial space between the sockets is occupied by a pin and each interstitial space between the pins is occupied by a socket; and a plurality of rows, each row arranged in an alternating sequence of sockets and pins such that each interstitial space between the sockets is occupied by a pin and each interstitial space between the pins is occupied by a socket;

such that each pin of the first terminal assembly can mate with a corresponding socket of the second terminal assembly, and each pin of the second terminal assembly can mate with a corresponding socket of the first terminal assembly.

37. The method of manufacturing an intercoupling component of claim 36, wherein the first terminal assembly and the second terminal assembly are identical.

38. The method of manufacturing an intercoupling component of claim 36, wherein the height of at least one pin of the first plurality of pins of the first terminal assembly is different than the height of every other pin of the first plurality of pins of the first terminal assembly; and the height of at least one pin of the second plurality of pins of the second terminal assembly is different than the height of every other pin of the second plurality of pins of the second terminal assembly.

39. The terminal assembly of claim 1 wherein the opening of each socket is disposed within the insulating support member.

40. The intercoupling component of claim 15 wherein the opening of each socket of the first plurality of sockets is disposed within first insulating support member and the opening of each socket of the second plurality of sockets is disposed within second insulating support member.

41. The method of manufacturing a terminal assembly of claim 28 wherein the opening of each socket is disposed within the insulating support member.

42. The method of manufacturing an intercoupling component of claim 35 wherein the opening of each socket of the first plurality of sockets is disposed within first insulating support member and the opening of each socket of the second plurality of sockets is disposed within second insulating support member.

* * * * *